US012270218B2

(12) United States Patent
Qiu et al.

(10) Patent No.: US 12,270,218 B2
(45) Date of Patent: Apr. 8, 2025

(54) DOUBLE-SPLICED FOLDABLE TENT WITH CENTRAL LIFTING AND AUTOMATIC OPENING AND CLOSING STRUCTURE

(71) Applicant: Wuyi Letu Leisure Products Co.,Ltd, Jinhua (CN)

(72) Inventors: Xin Qiu, Jinhua (CN); Huakai Pan, Jinhua (CN); Xuanyin Tao, Jinhua (CN)

( * ) Notice: Subject to any disclaimer, the term of this patent is extended or adjusted under 35 U.S.C. 154(b) by 157 days.

(21) Appl. No.: 18/116,862

(22) Filed: Mar. 3, 2023

(65) Prior Publication Data

US 2023/0203834 A1 Jun. 29, 2023

(30) Foreign Application Priority Data

Dec. 15, 2022 (CN) ..... 202223394900.8

(51) Int. Cl.

| | |
|---|---|
| ***E04H 15/50*** | (2006.01) |
| ***E04H 15/18*** | (2006.01) |
| ***E04H 15/54*** | (2006.01) |
| ***E04H 15/64*** | (2006.01) |

(52) U.S. Cl.

CPC ..... *E04H 15/505* (2013.01); *E04H 15/18* (2013.01); *E04H 15/54* (2013.01); *E04H 15/64* (2013.01)

(58) Field of Classification Search

CPC ..... E04H 15/50; E04H 15/505

See application file for complete search history.

(56) References Cited

U.S. PATENT DOCUMENTS

| | | | | |
|---|---|---|---|---|
| 4,779,635 | A * | 10/1988 | Lynch | E04H 15/50 52/109 |
| 5,274,980 | A * | 1/1994 | Zeigler | E04H 15/50 52/646 |
| 5,421,356 | A * | 6/1995 | Lynch | E04H 15/50 411/338 |
| 7,240,686 | B2 * | 7/2007 | Seo | E04H 15/50 135/159 |
| 7,832,170 | B2 * | 11/2010 | Zeigler | E04H 15/50 52/645 |
| 9,845,614 | B2 * | 12/2017 | Huang | E04H 15/52 |
| 9,995,056 | B2 * | 6/2018 | Yang | E04H 15/50 |
| 2005/0155637 | A1 * | 7/2005 | Kim | E04H 15/50 135/131 |
| 2014/0261601 | A1 | 9/2014 | Jin | |
| 2015/0068573 | A1 | 3/2015 | Jin | |
| 2015/0167344 | A1 | 6/2015 | Jin | |
| 2022/0412117 | A1 * | 12/2022 | Yan | E04H 15/64 |

* cited by examiner

*Primary Examiner* — Noah Chandler Hawk
(74) *Attorney, Agent, or Firm* — Sandy Liplin

(57) ABSTRACT

Disclosed is a double-spliced foldable tent with central lifting and automatic opening and closing structure, including two groups of central tops, one group of middle frame and two groups of edge frames. Any group of edge frame and middle frame are connected by telescopic fork frame. Two groups of side inclined frames are arranged between a group of central top and middle frame. At least one group of side inclined frame is arranged between a group of central top and a group of edge frame. One group of central tops includes an upper top and a lower support locked or separated by spring pin. One group of side inclined frame includes a first inclined rod hinged on upper top at one end and a second inclined rod hinged on lower support at one end, of which the other end is hinged on the side wall of first inclined rod.

7 Claims, 10 Drawing Sheets

DOUBLE-SPLICED FOLDABLE TENT WITH CENTRAL LIFTING AND AUTOMATIC OPENING AND CLOSING STRUCTURE

CROSS REFERENCE TO RELATED APPLICATION

This patent application claims the benefit and priority of Chinese Patent Application No. 202223394900.8 filed on Dec. 15, 2022, the disclosure of which is incorporated by reference herein in its entirety as part of the present application.

TECHNICAL FIELD

The present disclosure relates to the technical field of foldable tents, in particular to double-spliced foldable tents, and more specifically, to a double-spliced foldable tent with central lifting and automatic opening and closing structure.

BACKGROUND ART

Foldable tents are popular among outdoor activists because of their small volume when folding and large shelter space after unfolding. In order to expand the continuous shelter space of the tent, the single roof tents are usually spread out and used together. However, the tarpaulin of the roof single tents is also independent, and there are gaps between adjacent tents. In case of rainy days and other bad weather, the adjacent tents are prone to water leakage or wind leakage. Therefore, the foldable tents with double roofs and large space came into being.

In some tents, such as a stable foldable canopy with issuing publication No. CN205875902U, one of the central tops and a group of inclined frame are hinged by only one inclined rod. When the double roof tent is fully deployed, the foot frames at the four corners of the double roof tent cannot be moved outward. However, because the angle of articulation between the inclined rod and the central top cannot be guaranteed to be unchanged, that is, under the action of external forces such as impact or wind, the foot frames are easy to move towards the direction of the central top, and the angle of articulation between the inclined rod and the central top will change. Therefore, the double roof tent is unstable when fully deployed, and is easy to collapse due to external forces.

In some tents, such as a foldable tent with issuing publication No. CN208830822U, one of the central tops is composed of an upper top and a lower support. Although the upper top and the lower support are connected through the inclined frame, the upper top and the lower support cannot be locked. After the double roof tent is fully deployed, the lower support can still move relative to the upper top, that is, the stability of the double roof tent after deployment cannot be achieved through the lower support. There is still the situation that the foot frames at the four corners of the double roof tent moves due to external forces, resulting in instability and easy folding of the double roof tent after fully deployed.

SUMMARY

The present disclosure aims at the problem that the existing double roof tents realize the deployment by pulling the foot frames at the four corners, but the non-locking structure is easy to cause the foot frames to retract and move inward, which leads to folding. The technical problem to be solved by the present disclosure is to provide a double-spliced foldable tent with central lifting and automatic opening and closing structure that ensures the stability of the double roof tent after deployment by locking the spring pin between the upper top and the lower support of the central top.

The technical scheme adopted by the present disclosure to solve the above technical problems is as follows. The double-spliced foldable tent with central lifting and automatic opening and closing structure includes two groups of central tops, one group of middle frame and two groups of edge frames.

The middle frame is arranged between two groups of the edge frames, one group of the central top is arranged between the middle frame and one group of the edge frame, and the other group of the central top is arranged between the middle frame and the other group of the edge frame.

Two groups of side inclined frames are arranged between any group of the central top and the middle frame, at least one group of the side inclined frames are arranged between the central top and any group of the edge frame, and two groups of telescopic fork frames are arranged between any group of the edge frame and the middle frame.

A group of the central top includes an upper top and a lower support which are inserted for limiting position or separated, a group of the inclined frame includes a first inclined rod hinged to the upper top at one end and a second inclined rod hinged to the lower support at one end, and the other end of the second inclined rod is hinged to a side wall of the first inclined rod.

The upper top is provided with an inserting section, the lower support is provided with an insertion hole, the inserting section is provided with a spring pin, an inner wall of the insertion hole is provided with a pin hole, the upper top can be inserted into the insertion hole through the inserting section and is connected with the lower support for limiting position by inserting the spring pin into the pin hole.

An outer wall of the insertion hole is provided with a switch piece, and when the switch piece is pressed, the spring pin retracts and deviates from the pin hole.

A further preferred scheme of the present disclosure is as follows: the upper top includes a top cover and an insertion connector, the top cover is hinged with one end of at least three of the first inclined rods, the top cover is provided with a mounting hole A, and the insertion connector is successively provided with an upper section, an exposed section and the inserting section from top to bottom, the insertion connector is fixed by inserting the upper section into the mounting hole A, and the lower end of the inserting section is provided with a tip with a smaller lower part and a larger upper part.

A further preferred scheme of the present disclosure is as follows: the lower support includes a socket piece and a bottom cover, the bottom cover is hinged with one end of at least three second inclined rods, the insertion hole and pin hole are arranged on the socket piece, the bottom cover is provided with a mounting hole B, and a lower end of the socket piece is provided with an insertion section inserted into the mounting hole B.

A further preferred scheme of the present disclosure is as follows: the mounting hole A, the upper section, the exposed section, the inserting section, the mounting hole B, the insertion hole and the insertion section are all non-cylindrical structures.

A further preferred scheme of the present disclosure is as follows: a group of the side inclined frame also includes a third inclined rod and a fourth inclined rod, one end of the third inclined rod is hinged with the other end of the first inclined rod, and one end of the fourth inclined rod is hinged at a position where the third inclined rod deviates from both ends.

A further preferred scheme of the present disclosure is as follows: the middle frame includes two groups of middle corner frames, one group of the middle corner frames is connected with one group of the side inclined frame, one group of the middle corner frame includes an middle top sleeve, an middle outer tube, an middle inner tube and an middle sliding sleeve, the middle top sleeve is fixed on an upper end of the middle outer tube, the other end of the third inclined rod of the group of the side inclined frame is hinged on the middle top sleeve, and the middle sliding sleeve is slidably installed on the middle outer tube, the other end of the fourth inclined rod of the side inclined frame is hinged on the middle sliding sleeve, and the middle inner tube is arranged in the middle outer tube, and capable of telescoping or locking relative to the middle outer tube.

A further preferred scheme of the present disclosure is as follows: the middle frame also includes a middle top cover and two groups of middle inclined frames, one group of the middle inclined frame connects the middle top cover and a group of the middle corner frame, one group of the middle inclined frame includes a inclined rod A, a inclined rod B, a inclined rod C and a inclined rod D, the inclined rod A is hinged with the inclined rod B at a position that deviates from both ends, the inclined rod C is hinged with the inclined rod D at a position that deviates from both ends, one end of the inclined rod A is hinged and connected with the middle top cover, the other end of the inclined rod A is hinged with one end of the inclined rod C, the other end of the inclined rod C is hinged on the middle top sleeve, one end of the inclined rod B is hinged with one end of the inclined rod D, the other end of the diagonal rod D is hinged on the middle sliding sleeve, and the other ends of each two the inclined rods B in two groups of the middle inclined frames are mutually hinged.

A further preferred scheme of the present disclosure is as follows: the edge frame includes a group of edge corner frame, a group of the edge corner frame connects the adjacent middle corner frame through a group of the telescopic fork frame, a group of edge corner frame connects a group of side inclined frame, a group of the edge corner frame includes an edge top sleeve, an edge outer tube, an edge inner tube and an edge sliding sleeve, the edge top sleeve is fixed on an upper end of the edge outer tube, and the other end of the third inclined rod of the group of side inclined frame is hinged on the edge top sleeve, the edge sliding sleeve is slidably installed on the edge outer tube, the other end of the fourth inclined rod of the side inclined frame is hinged on the edge sliding sleeve, and the edge inner tube is arranged in the edge outer tube, and capable of telescoping or locking relative to the edge outer tube.

A further preferred scheme of the present disclosure is as follows: the edge frame includes at least two groups of edge corner frames, one group of edge corner frame connects the adjacent middle corner frame through a group of the telescopic fork frame, a group of telescopic fork frame are arranged between two groups of the adjacent edge corner frames for connection, one group of the edge corner frame connects a group of the side inclined frame, one group of the edge corner frame includes an edge top sleeve, an edge outer tube, an edge inner tube and an edge sliding sleeve, the edge top sleeve is fixed on an upper end of the edge outer tube, the other end of the third inclined rod of the group of side inclined frame is hinged on the edge top sleeve, the edge sliding sleeve is slidably installed on the edge outer tube, the other end of the fourth inclined rod of the side inclined frame is hinged on the edge sliding sleeve, and the edge inner tube is arranged in the edge outer tube, and capable of telescoping or locking relative to the edge outer tube.

A further preferred scheme of the present disclosure is as follows: the telescopic fork frame includes multiple groups of central hinged fork rods A and fork rods B; in two adjacent groups of fork rods A and fork rods B, one end of the fork rod A in one group is hinged with the other end of the fork rod B in the other group; two unhinged ends are respectively arranged on two sides of the telescopic fork frame, the unhinged ends on one side are correspondingly hinged on the edge top sleeve and the edge sliding sleeve of a group of the edge corner frame on a one-to-one basis, the unhinged ends on the other side are correspondingly hinged on the edge top sleeve and the edge sliding sleeve of the other group of the edge corner frame on a one-to-one basis.

Or, the unhinged ends on the other side are correspondingly hinged on the middle top sleeve and the middle sliding sleeve of the adjacent middle corner frame on a one-to-one basis.

Compared with the prior art, the present disclosure has the following advantages: the lower support on the central top is arranged, so that when the double roof tent is opened or folded, the locking connection or separation between the lower support and the upper top is quickly achieved, the double roof tent is more stable after being unfolded by means of the locking connection of the spring pin, and the double roof tent folding caused by the inward telescoping movement of the side foot frames does not easily occur.

BRIEF DESCRIPTION OF THE DRAWINGS

Hereinafter, the present disclosure will be described in further detail with reference to the accompanying drawings and preferred embodiments. However, it will be appreciated that, for those skilled in the art, the drawings are drawn merely for the purpose of illustrating the preferred embodiments, and therefore should not be taken as limiting the scope of the disclosure. In addition, unless specified, the drawings are merely illustrative in conceptual representation of the composition or construction of the objects described and may include exaggerated displays, and are not necessarily drawn to scale.

Figure 1:
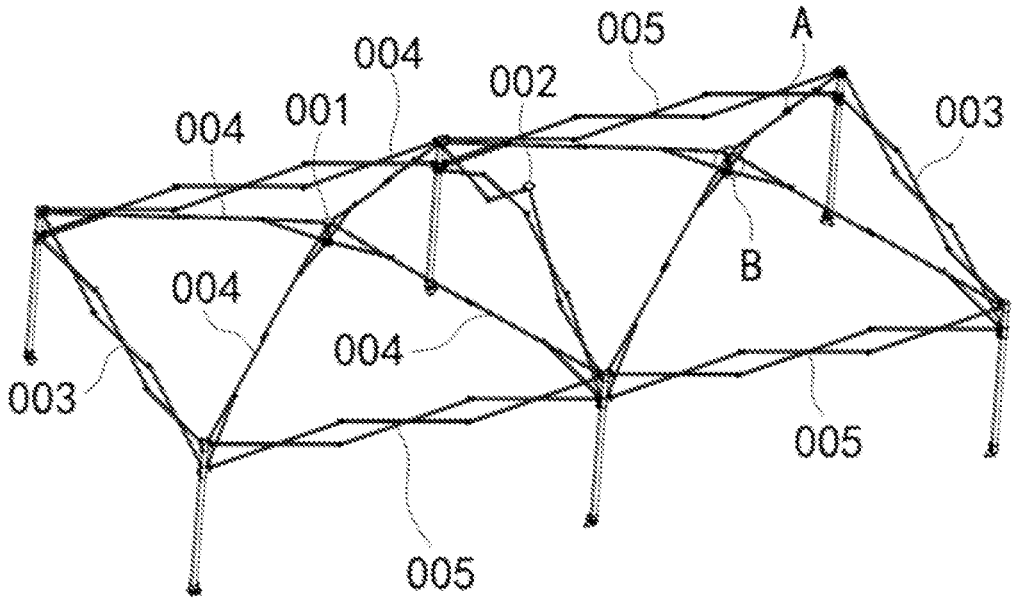
FIG. 1 is the structural diagram of the double roof tent in the preferred embodiment of the present disclosure.
Figure 2:
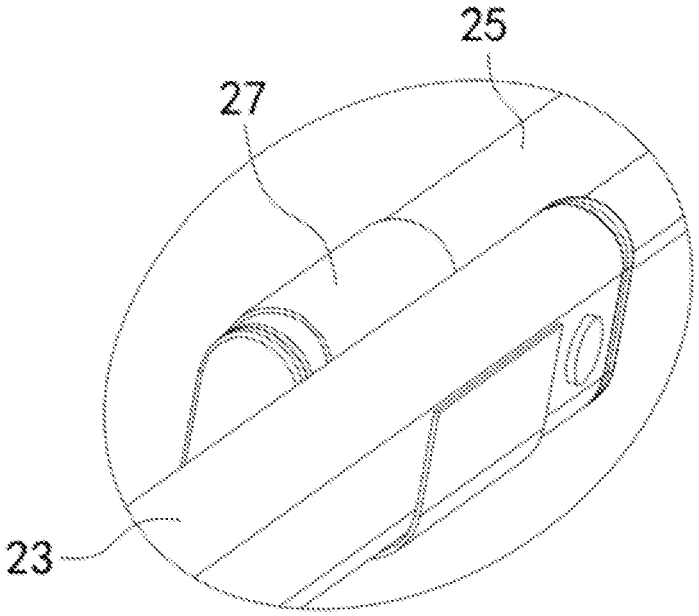
FIG. 2 is an enlarged schematic diagram of part A in FIG. 1 of the preferred embodiment of the present disclosure.
Figure 3:
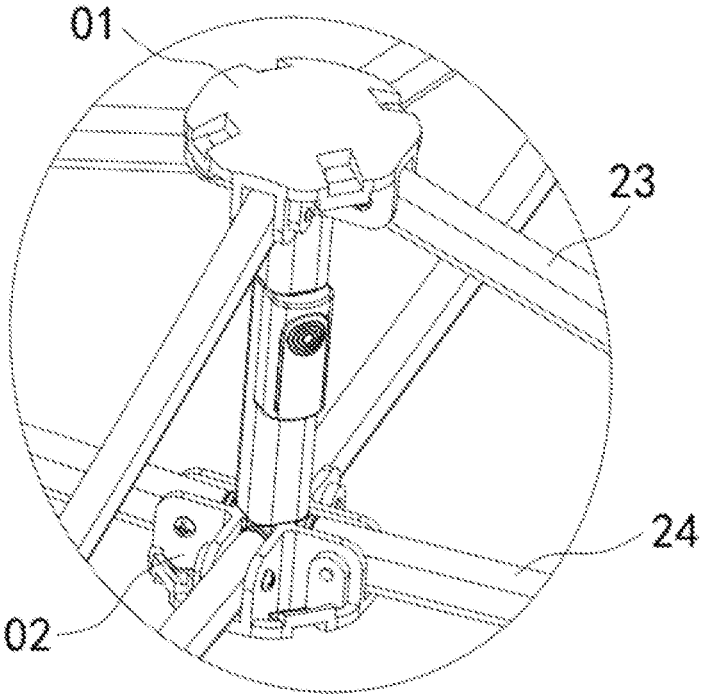
FIG. 3 is an enlarged schematic diagram of part B in FIG. 1 of the preferred embodiment of the present disclosure.
Figure 4:
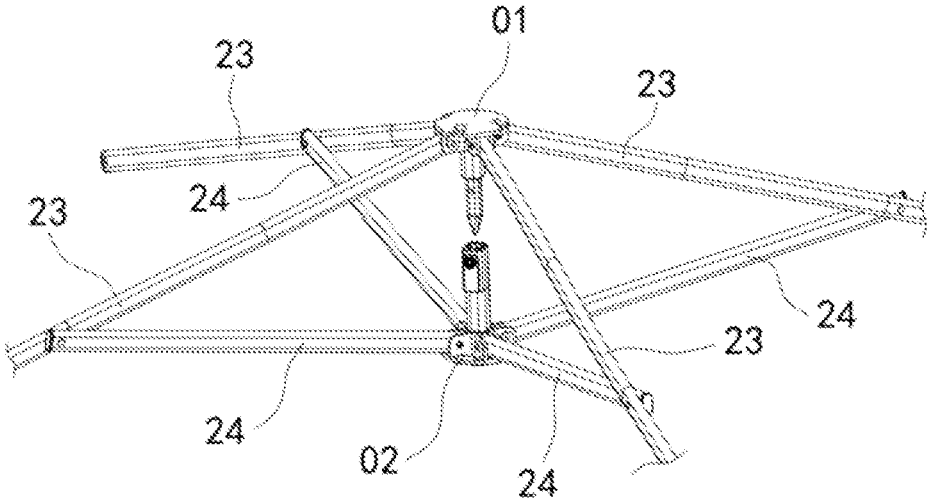
FIG. 4 is the structural diagram of the central top connecting the side inclined frame in the preferred embodiment of the present disclosure.
Figure 5:
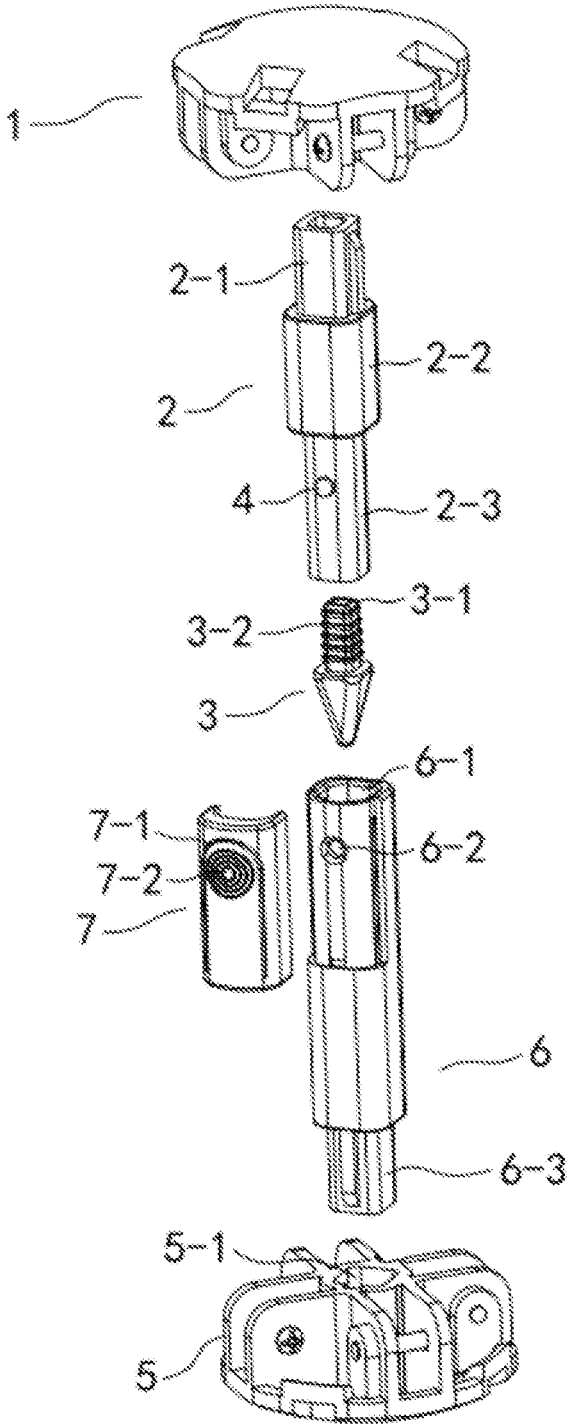
FIG. 5 is an exploded view of the central top of the preferred embodiment of the present disclosure.
Figure 6:
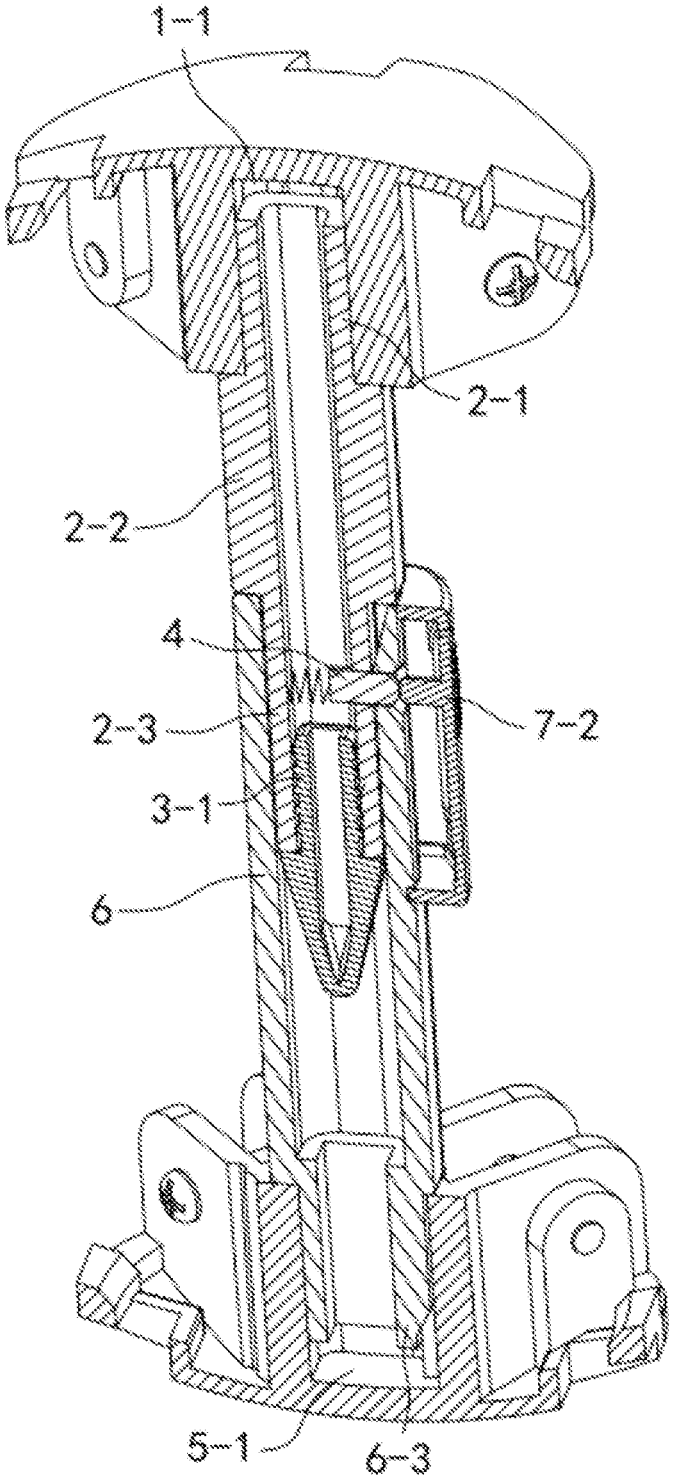
FIG. 6 is a sectional view of the central top of the preferred embodiment of the present disclosure.
Figure 7:
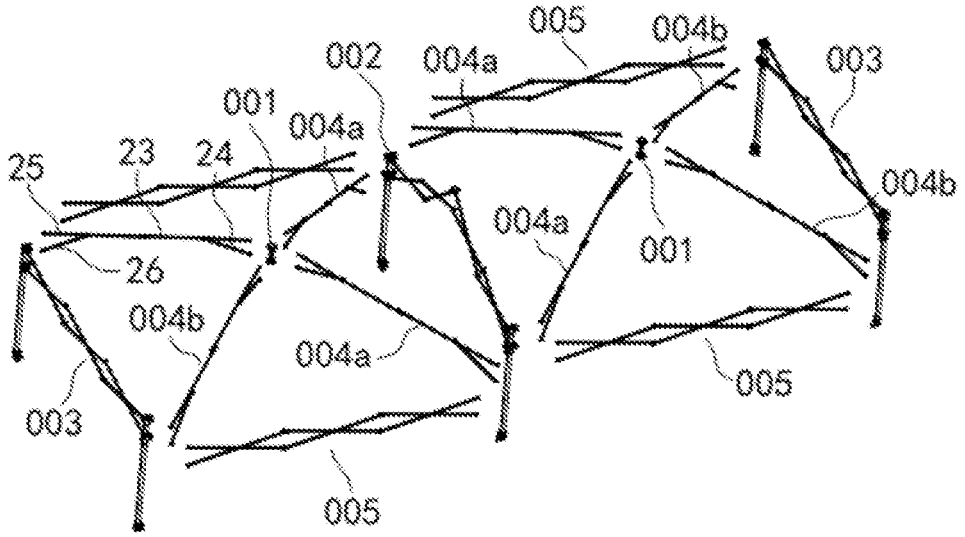
FIG. 7 is an exploded view of the double roof tent in the preferred embodiment of the present disclosure.

In the figures: 001, central top: 01, upper top; 1, top cover, 1-1, mounting hole A; 2, insertion connector, 2-1, upper section, 2-2, exposed section, 2-3, inserting section; 3, tip, 3-1, cannula, 3-2, convex part; 4, spring pin; 02, lower support; 5, bottom cover, 5-1, mounting hole B; 6, socket piece, 6-1, insertion hole, 6-2, pin hole, 6-3, insertion section; 7, switch piece, 7-1, operation hole, 7-2, pressing part;

002, middle frame: 8, middle top cover; 03, middle inclined frame; 9, inclined rod A; 10, inclined rod B; 11, inclined rod C; 12, inclined rod D; 04, middle corner frame; 13, middle top sleeve; 14, middle outer tube; 15, middle inner tube; 16, middle sliding sleeve; 17, middle locking piece;

003, edge frame: 05, edge corner frame; 18, edge top sleeve; 19, edge outer tube; 20, edge inner tube; 21, edge sliding sleeve; 22, edge locking piece;

004, side inclined frame, 004*a*, middle side inclined frame, 004*b*, edge side inclined frame: 23, first inclined rod; 24, second inclined rod; 25, third inclined rod; 26, fourth inclined rod; 27, S-shaped buckle;

005, telescopic fork frame: 28, fork rod A; 29, fork bar B.

DETAILED DESCRIPTION OF THE EMBODIMENTS

Preferred embodiments of the present disclosure will be described in detail below with reference to the accompanying drawings, and those skilled in the art will appreciate that the descriptions are only illustrative and exemplary, and should not be construed as limiting the scope of protection of the present disclosure.

It should be noted that like reference numbers refer to similar items in the following figures, and thus, once an item is defined in one figure, it may not be further defined and explained in subsequent figures.

The embodiment mainly describes a double-spliced foldable tent with central lifting and automatic opening and closing structure, which ensures the stability of the double roof tent after deployment by locking the spring pin between the upper top and the lower support of the central top, as follows.

As shown in FIG. 1 to FIG. 10, the double-spliced foldable tent with central lifting and automatic opening and closing structure includes two groups of central tops 001, one group of middle frame 002 and two groups of edge frames 003. The middle frame 002 is arranged between two groups of edge frames 003 and two groups of central tops 001, and one group of central top 001 is arranged between the middle frame 002 and one group of edge frame 003. Two groups of side inclined frames 004 are arranged between one group of central top 001 and the middle frame 002, and two groups of side inclined frames 004 are arranged between one group of central top 001 and one group of edge frame 003, while two groups of telescopic fork frames 005 are arranged between one group of edge frame 003 and the middle frame 002. Preferably, the spacing between the middle frame 002 and the edge frame 003 can be adjusted through the telescopic fork frames 005, and the width of the middle frame 002 and the edge frame 003 can be adjusted.

One group of side inclined frame 004 includes a first inclined rod 23, a second inclined rod 24, a third inclined rod 25 and a fourth inclined rod 26, wherein one end of the first inclined rod 23 and one end of the second inclined rod 24 are hinged on the central top 001, the first inclined rod 23 is hinged with the other end of the second inclined rod 24 at the position where it deviates from both ends, the other end of the first inclined rod 23 is hinged with one end of the third inclined rod 25, and the third inclined rod 25 is hinged with one end of the fourth inclined rod 26 at the position where it deviates from both ends. The other end of the third inclined rod 25 and the other end of the fourth inclined rod 26 are hinged on the middle frame 002 or a group of edge frame 003. Preferably, in order to distinguish the side inclined frame 004 connected with the middle frame 002 or the edge frame 003, the side inclined frame 004 connected with the middle frame 002 is called the middle side inclined frame 004*a* in the following description, and the side inclined frame 004 connected with the edge frame 003 is called the edge side inclined frame 004*b* in the following description.

Preferably, a group of central top 001 is hinged with four first inclined rods 23 and four second inclined rods 24.

In order to avoid the relative rotation of the first inclined rod 23 and the third inclined rod 25 after the side inclined frame 004 is unfolded, the third inclined rod 25 is fixed with an S-shaped buckle 27, and the S-shaped buckle 27 can limit the rotation angle of the first inclined rod 23 when it deviates from the third inclined rod 25.

As shown in FIG. 3 to FIG. 6, a group of central top 001 includes an upper top and a lower support which are inserted for limiting position or separated. The first inclined rod 23 in a group of middle side inclined frame 004*a* is hinged on the upper top 01, and the second inclined rod 24 of the group of middle side inclined frame 004*a* is hinged on the lower support 02. The upper top 01 is provided with an inserting section 2-3, the lower support 02 is provided with an insertion hole 6-1, and the inserting section 2-3 is provided with a spring pin 4. The inner wall of the insertion hole 6-1 is provided with a pin hole 6-2. Through the rotation of the second inclined rod 24 relative to the first inclined rod 23, the space between the upper top 01 and the lower support 02 becomes larger or smaller. The upper top 01 can be inserted into the insertion hole 6-1 through the inserting section 2-3, and is connected with the lower support 02 by inserting the spring pin 4 into the pin hole 6-2.

When the upper top 01 and the lower support 02 are locked by the spring pin 4, the four second inclined rods 24 hinged on the lower support 02 cannot rotate relative to the first inclined rod 23, that is, the rotation of the first inclined rod 23 relative to the third inclined rod 25 is limited by the S-shaped buckle 27, and under the action of the fourth inclined rod 26, the spacing from the central top 001 to the middle frame 002 and the edge frame 003 is limited, so that the double roof tent will not be folded due to the offset of the four corners.

In this embodiment, the upper top 01 includes a top cover 1 hinged with the first inclined rod 23 and an insertion connector 2 which is inserted and fixed below the top cover 1. The top cover 1 is provided with a mounting hole A 1-1, and the insertion connector 2 is provided with an upper section 2-1, an exposed section 2-2 and the abovementioned inserting section 2-3 from top to bottom. The external dimension of exposed section 2-2 is larger than that of the upper section 2-1 and inserting section 2-3. The insertion connector is inserted into the mounting hole A 1-1 through the upper section 2-1, the insertion connector 2 and top cover 1 are fixedly connected by screwing a screw into a side wall of the mounting hole A 1-1.

In order to facilitate the insertion of the insertion section 2-3 of the insertion connector 2 into the insertion hole 6-1 of the lower support 02, a tip 3 with a smaller lower part and a larger upper part is provided at a lower end of the inserting section 2-3. An upper end face of the tip 3 is integrally formed with a cannula 3-1, an outer wall of the cannula 3-1 is provided with several bulges, the tip 3 is inserted into the inserting section 2-3 of the insertion connector 2 through the cannula 3-1, and several bulges on the outer wall of the cannula 3-1 are tightly adhered and fixed to an inner wall of the inserting section 2-3.

In order to prevent the inserting section 2-3 of the insertion connector 2 from being deflected when being fixed in the mounting hole A 1-1, both the mounting hole A 1-1 and the upper section 2-1 of the insertion connector 2 are of a non-cylindrical structure; or when the mounting hole A 1-1 and the upper section 2-1 of the insertion connector 2 are of a cylindrical structure, a matching slot and convex part 3-2 are provided on an inner wall of the mounting hole A 1-1 and an outer wall of the upper section 2-1 to limit rotation therebetween. Preferably, in order to ensure the integrity of the insertion connector 2, the tip 3, the exposed section 2-2 and the inserting section 2-3 of the insertion connector 2 may all adopt a non-cylindrical structure.

In this embodiment, the lower support 02 includes a bottom cover 5 hinged to the second inclined rod 24, and a socket piece 6 fixed above the bottom cover 5 in an inserting manner An insertion hole 6-1 and a pin hole 6-2 are provided on the socket piece 6. The insertion hole 6-1 is in communication with an upper end face of the socket piece 6. A mounting hole B 5-1 is provided on the bottom cover 5. An insertion section 6-3 inserted into the mounting hole B 5-1 is provided at a lower end of the socket piece 6. A fixing method between the insertion section 6-3 and the mounting hole B 5-1 and shapes can refer to the mounting hole A 1-1 and the upper section 2-1. In order to ensure the aesthetic appearance after the upper top 01 and the lower support 02 are locked by the spring pin 4, the inserting end of the insertion connector 2 of the upper top 01 can be completely inserted into the insertion hole 6-1 of the socket piece 6. In order to ensure the overall aesthetic appearance of the central top 001, the outer wall of the insertion hole 6-1 is of a non-cylindrical structure as the outer wall of the exposed section 2-2 of the insertion connector 2.

In order to conveniently press and push out the spring pin 4 inserted into the pin hole 6-2, a switch piece 7 is installed on the socket piece 6. The switch piece 7 is fixed on the outer wall of the insertion hole 6-1 of the socket piece 6. The switch piece 7 is provided with an operation hole 7-1. A pressing part 7-2 is provided in the operation hole 7-1, and one end of the pressing part 7-2 is connected to a hole wall of the operation hole 7-1, the other end can be pressed. By performing a pressing operation on the pressing part 7-2 of the switch piece 7, the pressing part 7-2 can push the pin shaft to withdraw from the pin hole 6-2, and the upper top 01 and the lower support 02 can be separated from each other.

Figure 8:
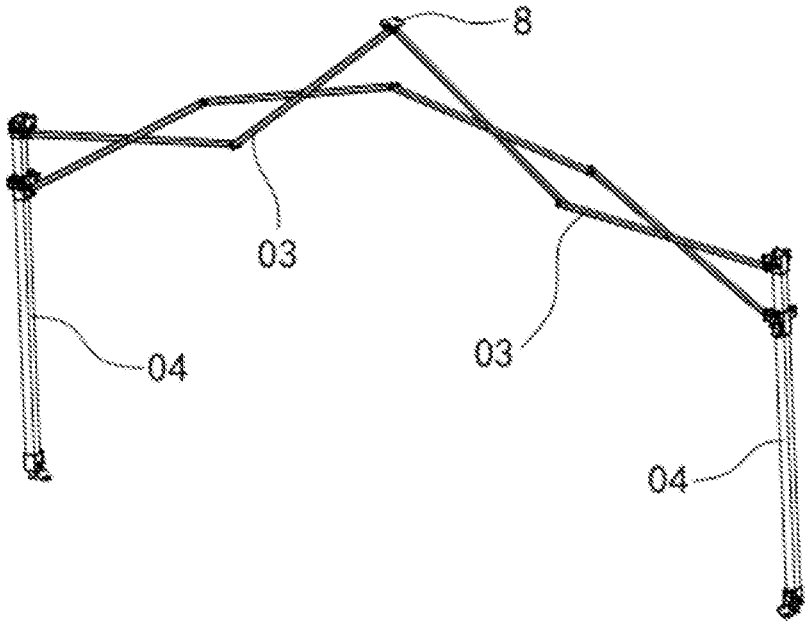
FIG. 8 is the structural diagram of the middle frame in the preferred embodiment of the present disclosure.
Figure 9:
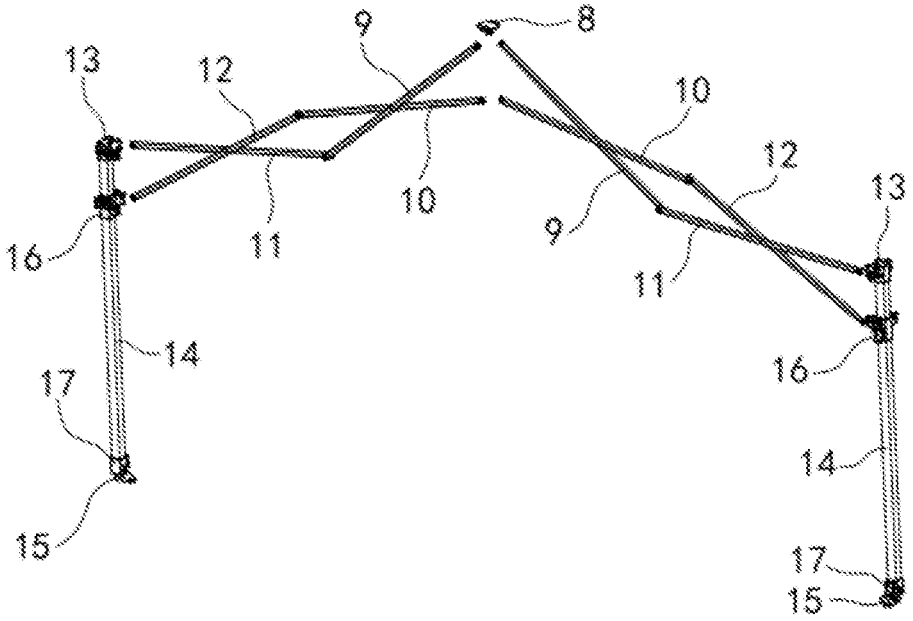
FIG. 9 is an exploded view of the middle frame of the preferred embodiment of the present disclosure.

As shown in FIG. 8 and FIG. 9, the middle frame 002 includes a middle top cover 8, two groups of middle inclined frames 03 and two groups of middle corner frames 04, the middle top cover 8 is connected to two groups of the middle inclined frames 03, and the two groups of middle inclined frames 03 are located between the two groups of the middle corner frames 04. The third inclined rod 25 and the fourth inclined rod 26 of one group of middle side inclined frame 004*a* are hinged to one group of the middle corner frame 04. Preferably, the spacing between two groups of the middle corner frames 04 can adjusted through the hinged connection of two groups of the middle inclined frames 03.

One group of the middle inclined frame 03 includes a inclined rod A 9, a inclined rod B 10, a inclined rod C 11 and a inclined rod D 12. The inclined rod A 9 is hinged with the inclined rod B 10 at a position that deviates from both ends, the inclined rod C 11 is hinged with the inclined rod D 12 at a position that deviates from both ends. One end of the inclined rod C 11 and one end of the inclined rod D 12 are hinged on the middle corner frame 04, one end of the inclined rod A 9 is hinged with the other end of the inclined rod C 11, the other end of the inclined rod A 9 is hinged on the middle top cover 8, one end of the inclined rod B 10 is hinged with the other end of the inclined rod D 12, and the other ends of each two the inclined rods B 10 in two groups of the middle inclined frames 03 are mutually hinged.

A group of middle corner frame 04 includes a middle top sleeve 13, a middle outer tube 14, a middle inner tube 15, a middle sliding sleeve 16 and a middle locking piece 17. The middle inner tube 15 is arranged in the middle outer tube 14 for telescopic installation. The lower end of the middle outer tube 14 is provided with the middle locking piece 17. The middle locking piece 17 restricts the telescopic adjustment of the middle inner tube 15 relative to the middle outer tube 14 through a structure of the spring pin 4. The middle top sleeve 13 is fixed on the upper end of the middle outer tube 14 in a sleeve manner. And the middle sleeve 16 is sleeved on the middle outer tube 14 and is slidably mounted on the middle outer tube 14.

The inclined rod C 11 of the middle inclined frame 03 and the third inclined rod 25 of the middle side inclined frame 004*a* are hinged on the middle top sleeve 13, and the inclined rod D 12 of the middle inclined frame 03 and the fourth inclined rod 26 of the middle side inclined frame 004*a* are hinged on the middle sliding sleeve 16. Preferably, one middle top sleeve 13 is hinged with one inclined rod C 11 and two third inclined rods 25, and one middle sliding sleeve 16 is hinged with one inclined rod D 12 and two fourth inclined rods 26.

Figure 10:
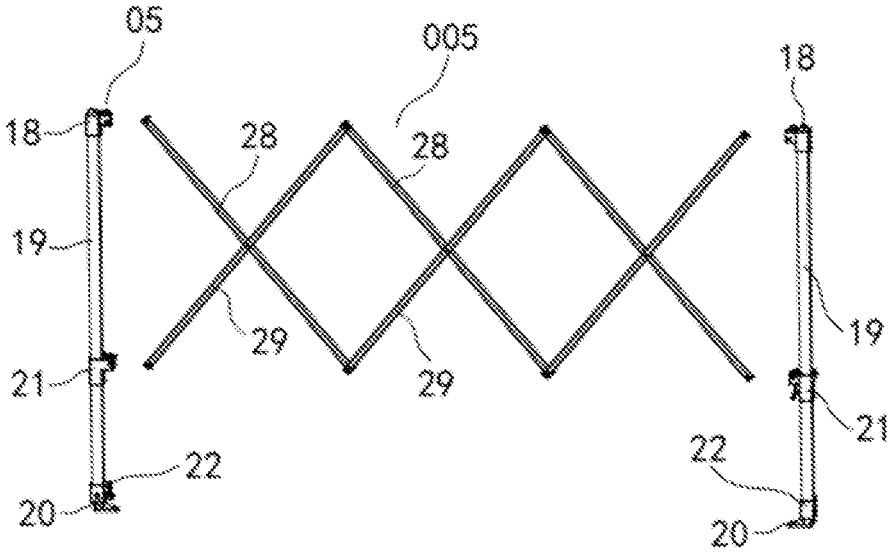
FIG. 10 is an exploded view of the edge frame of the preferred embodiment of the present disclosure.

As shown in FIG. 10, a group of edge frame 003 includes two groups of edge corner frames 05 and a group of telescopic fork frame 005. The group of telescopic fork frame 005 connects two groups of edge corner frames 05, and the spacing between the two groups of edge corner frames 05 can be adjusted through the group of telescopic fork frame 005. And a group of edge corner frame 05 connects the third inclined rod 25 and the fourth inclined rod 26 of a group of edge side inclined frame 004*b*. Preferably, a group of telescopic fork frame 005 connecting the edge frame 003 and the middle frame 002 connects a group of edge corner frame 05 of the edge frame 003 and a group of middle corner frame 04 of the middle frame 002.

A group of the edge corner frame 05 includes an edge top sleeve 18, an edge outer tube 19, an edge inner tube 20, an edge sliding sleeve 21 and an edge locking piece 22. The edge inner tube 20 is arranged in the edge outer tube 19 for telescopic installation. The lower end of the edge outer tube 19 is equipped with the edge locking piece 22, and the edge locking piece 22 restricts the telescopic adjustment of the edge inner tube 20 relative to the edge outer tube 19 through the structure of the spring pin 4. The edge top sleeve 18 is fixed at the upper end of the edge outer tube 19 in a sleeve manner, and the edge sliding sleeve 21 is sleeved on the edge outer tube 19 for sliding installation, while the third inclined rods 25 of the edge side inclined frame 004*b* are hinged on the edge top sleeve 18, and the fourth inclined rods 26 of the middle side inclined frame 004*a* are hinged on the side sliding sleeve 21. Preferably, one side top sleeve 18 is hinged with one third inclined rod 25, and one side sliding sleeve 21 is hinged with one fourth inclined rod 26.

In this embodiment, the telescopic fork frame 005 is composed of multiple groups of fork rods A 28 and fork rods B 29 which are hinged at the centers. In two adjacent groups of fork rods A 28 and fork rods B 29, one end of the fork rod A 28 in one group is hinged with the other end of the fork rod B 29 in the other group. Therefore, two unhinged ends are respectively arranged on two sides of the telescopic fork frame 005. Preferably, one group of edge corner frame 05 connects two groups of telescopic fork frames 005 through the edge top sleeve 18 and the edge sliding sleeve 21, and one group of the middle corner frame 04 connects two groups of the telescopic fork frames 005 through the middle top sleeve 13 and the middle sliding sleeve 16.

For the telescopic fork frame 005 which belongs to a group of edge frame 003 and is arranged between two groups of edge corner frames 05, the unhinged ends on one side of the telescopic fork frame 005 are correspondingly hinged on the edge top sleeve 18 and the edge sliding sleeve 21 of a group of the edge corner frame 05 on a one-to-one basis, the unhinged ends on the other side are correspondingly hinged on the edge top sleeve 18 and the edge sliding sleeve 21 of the other group of the edge corner frame 05 on a one-to-one basis.

For the telescopic fork frame 005 which connects a group of edge corner frame 05 and a group of middle corner frame 04, the unhinged ends on one side of the telescopic fork frame 005 are correspondingly hinged on the edge top sleeve 18 and the edge sliding sleeve 21 of a group of the edge corner frame 05 on a one-to-one basis, and the unhinged ends on the other side are correspondingly hinged on the middle top sleeve 13 and middle sliding sleeve 16 of the adjacent middle corner frame 04 on a one-to-one basis.

In the description of the present disclosure, it should be noted that the orientation or positional relationship indicated by the terms "up", "down", "front", "back", "inside", "outside" and the like is based on the orientation or positional relationship shown in the drawings, or is the orientation or position relationship of the product of the present disclosure that is traditionally placed when the product of the present disclosure is used. The orientation or positional relationship is only for the convenience of describing the present disclosure and simplifying the description of the present disclosure, rather than indicating or implying that the device or element referred to must have a particular orientation, be constructed and operated in a particular orientation, and therefore it cannot be construed as a limitation of the present disclosure.

The double-spliced foldable tent with central lifting and automatic opening and closing structure provided by the present disclosure is described in detail above, and the principle and implementation mode of the present disclosure are described in this paper by specific embodiments. The description of the above embodiments is only for helping to understand the present disclosure and its core idea. And it should be pointed out that for those skilled in the art, without departing from the principles of the present disclosure, it is also possible to make certain improvements and modifications to the present disclosure, which are also within the protection scope of the claims of the present disclosure.

What is claimed is:

1. A double-spliced foldable tent with central lifting and automatic opening and closing structure, comprising two groups of central tops, one group of middle frame and two groups of edge frames;

wherein the middle frame is arranged between two groups of the edge frames, one group of the central top is arranged between the middle frame and one group of the edge frame, and the other group of the central top is arranged between the middle frame and the other group of the edge frame;

two groups of side inclined frames are arranged between any group of the central top and the middle frame, at least one group of the side inclined frames are arranged between the central top and any group of the edge frame, and two groups of telescopic fork frames are arranged between any group of the edge frames and the middle frame;

a group of the central top comprises an upper top and a lower support which are inserted for limiting position or separated, a group of the inclined frame comprises a first inclined rod hinged to the upper top at one end and a second inclined rod hinged to the lower support at one end, and the other end of the second inclined rod is hinged to a side wall of the first inclined rod;

the upper top is provided with an inserting section, the lower support is provided with an insertion hole, the inserting section is provided with a spring pin, an inner wall of the insertion hole is provided with a pin hole, the upper top can be inserted into the insertion hole through the inserting section and is connected with the lower support for limiting position by inserting the spring pin into the pin hole; and an outer wall of the insertion hole is provided with a switch piece, and when the switch piece is pressed, the spring pin retracts and deviates from the pin hole;

wherein the upper top comprises a top cover and an insertion connector, the top cover is hinged with one end of at least three of the first inclined rods, the top cover is provided with a mounting hole A, and the insertion connector is successively provided with an upper section, an exposed section and the inserting section from top to bottom, the insertion connector is fixed by inserting the upper section into the mounting hole A, and the lower end of the inserting section is provided with a tip with a smaller lower part and a larger upper part, wherein the lower support comprises a socket piece and a bottom cover, the bottom cover is hinged with one end of at least three second inclined rods, the insertion hole and pin hole are arranged on the socket piece, the bottom cover is provided with a mounting hole B, and a lower end of the socket piece is provided with an insertion section inserted into the mounting hole B; and the mounting hole A, the upper section, the exposed section, the inserting section, the mounting hole B, the insertion hole and the insertion section are all non-cylindrical structures.

2. The double-spliced foldable tent with central lifting and automatic opening and closing structure of claim 1, wherein a group of the side inclined frame also comprises a third inclined rod and a fourth inclined rod, one end of the third inclined rod is hinged with the other end of the first inclined rod, and one end of the fourth inclined rod is hinged at a position where the third inclined rod deviates from both ends.

3. The double-spliced foldable tent with central lifting and automatic opening and closing structure of claim 2, wherein the middle frame comprises two groups of middle corner frames, one group of the middle corner frame is connected with one group of the side inclined frame, one group of the middle corner frame comprises an middle top sleeve, an middle outer tube, an middle inner tube and an middle sliding sleeve, the middle top sleeve is fixed on an upper end of the middle outer tube, the other end of the third inclined rod of the group of the side inclined frame is hinged on the middle top sleeve, and the middle sliding sleeve is slidably installed on the middle outer tube, the other end of the fourth inclined rod of the side inclined frame is hinged on the middle sliding sleeve, and the middle inner tube is arranged in the middle outer tube, and capable of telescoping or locking relative to the middle outer tube.

4. The double-spliced foldable tent with central lifting and automatic opening and closing structure of claim 3, wherein the middle frame also comprises a middle top cover and two groups of middle inclined frames, one group of the middle inclined frame connects the middle top cover and a group of the middle corner frame, one group of the middle inclined frame comprises a inclined rod A, a inclined rod B, a inclined rod C and a inclined rod D, the inclined rod A is hinged with the inclined rod B at a position that deviates from both ends, the inclined rod C is hinged with the inclined rod D at a position that deviates from both ends, one end of the inclined rod A is hinged and connected with the middle top cover, the other end of the inclined rod A is hinged with one end of the inclined rod C, the other end of the inclined rod C is hinged on the middle top sleeve, one end of the inclined rod B is hinged with one end of the inclined rod D, the other end of the inclined rod D is hinged on the middle sliding sleeve, and the other ends of each two the inclined rods B in two groups of the middle inclined frames are mutually hinged.

5. The double-spliced foldable tent with central lifting and automatic opening and closing structure of claim 4, wherein the edge frame comprises a group of edge corner frame, a group of the edge corner frame connects the adjacent middle corner frame through a group of the telescopic fork frame, a group of edge corner frame connects a group of the side inclined frame, a group of the edge corner frame comprises an edge top sleeve, an edge outer tube, an edge inner tube and an edge sliding sleeve, the edge top sleeve is fixed on an upper end of the edge outer tube, and the other end of the third inclined rod of the group of side inclined frame is hinged on the edge top sleeve, the edge sliding sleeve is slidably installed on the edge outer tube, the other end of the fourth inclined rod of the side inclined frame is hinged on the edge sliding sleeve, and the edge inner tube is arranged in the edge outer tube, and capable of telescoping or locking relative to the edge outer tube.

6. The double-spliced foldable tent with central lifting and automatic opening and closing structure of claim 5, wherein the telescopic fork frame comprises a plurality of groups of central hinged fork rods A and fork rods B; in two adjacent groups of fork rods A and fork rods B, one end of the fork rod A in one group is hinged with the other end of the fork rod B in the other group; two unhinged ends are respectively arranged on two sides of the telescopic fork frame, the unhinged ends on one side are correspondingly hinged on the edge top sleeve and the edge sliding sleeve of a group of the edge corner frame on a one-to-one basis, the unhinged ends on the other side are correspondingly hinged on the edge top sleeve and the edge sliding sleeve of the other group of the edge corner frame on a one-to-one basis; Or, the unhinged ends on the other side are correspondingly hinged on the middle top sleeve and the middle sliding sleeve of the adjacent middle corner frame on a one-to-one basis.

7. The double-spliced foldable tent with central lifting and automatic opening and closing structure of claim 4, wherein the edge frame comprises at least two groups of edge corner frames, one group of the edge corner frame connects the adjacent middle corner frame through a group of the telescopic fork frame, a group of telescopic fork frame are arranged between two groups of the adjacent edge corner frames for connection, one group of the edge corner frame connects a group of the side inclined frame, one group of the edge corner frame comprises an edge top sleeve, an edge outer tube, an edge inner tube and an edge sliding sleeve, the edge top sleeve is fixed on an upper end of the edge outer tube, the other end of the third inclined rod of the group of side inclined frame is hinged on the edge top sleeve, the edge sliding sleeve is slidably installed on the edge outer tube, the other end of the fourth inclined rod of the side inclined frame is hinged on the edge sliding sleeve, and the edge inner tube is arranged in the edge outer tube, and capable of telescoping or locking relative to the edge outer tube.

* * * * *